US006195920B1

(12) United States Patent
Morris et al.

(10) Patent No.: US 6,195,920 B1
(45) Date of Patent: Mar. 6, 2001

(54) GRINDING FOOTWEAR APPARATUS WITH STORAGE COMPARTMENT

(75) Inventors: Christopher H. Morris, Topanga; David G. Inman, Fullerton; Benjamin B. Kelley, Redondo Beach, all of CA (US)

(73) Assignee: Artemis Innovations Inc., Torrance, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/335,306

(22) Filed: Jun. 17, 1999

Related U.S. Application Data

(63) Continuation-in-part of application No. 08/890,595, filed on Jul. 9, 1997, now Pat. No. 6,006,451, which is a continuation-in-part of application No. 08/799,062, filed on Feb. 10, 1997, now Pat. No. 5,970,631

(60) Provisional application No. 60/022,318, filed on Jul. 23, 1996.

(51) Int. Cl.[7] ..... A43B 5/00; A43B 13/22; A43B 13/24

(52) U.S. Cl. ..... 36/132; 36/136; 36/54; 36/115

(58) Field of Search ..... 36/132, 136, 54, 36/115, 114, 107, 25 R, 82

(56) References Cited

U.S. PATENT DOCUMENTS

| | | | | |
|---|---|---|---|---|
| 2,897,609 | * | 8/1959 | Bodkin | 36/136 |
| 2,904,901 | * | 9/1959 | Goldstein | 36/136 |
| 5,655,316 | * | 8/1997 | Huang | 36/132 |
| 5,921,008 | * | 7/1999 | Ruff | 36/136 |
| 6,006,451 | * | 12/1999 | Morris et al. | 36/115 |

* cited by examiner

*Primary Examiner*—Paul T. Sewell
*Assistant Examiner*—Anthony Stashick
(74) *Attorney, Agent, or Firm*—Fulwider Patton Lee & Utecht, LLP

(57) ABSTRACT

An article of athletic footwear with a sole having a downwardly opening recess removably mounting a low friction grind plate for sliding across a protruding feature on a supporting surface and including an accessible storage compartment for temporarily storing keys and the like.

24 Claims, 5 Drawing Sheets

GRINDING FOOTWEAR APPARATUS WITH STORAGE COMPARTMENT

This application is a continuation-in-part of U.S. patent application Ser. No. 08/890,595, filed Jul. 9, 1997 now U.S. Pat. No. 6,006,451 Dec. 28, 1999 which was a Continuation-in-Part of Ser. No. 08/799,062, filed Feb. 10, 1997, now U.S. Pat. No. 5,970,631 Oct. 26, 1999 claiming priority of Provisional Application Ser. No. 60/022,318 filed Jul. 23, 1996, all of which are incorporated herein by reference.

BACKGROUND OF THE INVENTION

1. Field of the Invention

The present invention relates to articles of footwear, and more particularly to articles of footwear adapted to support the traditional functions of footwear as well as to facilitate sliding over, for instance, a pipe, a rail, an edged surface or the like.

2. Description of the Prior Art

In our earlier application Ser. No. 08/890,595, filed Jul. 9, 1997, now U.S. Pat. No. 6,006,451, we disclosed a grinding shoe apparatus incorporating a grind plate recessed upwardly into the bottom surface of a shoe sole for grinding along a support surface such as a rail or pipe or the like. This shoe apparatus itself, while having enjoyed considerable commercial success, has not satisfied all the needs in the marketplace. First, active athletes often carry with them numerous different items such as keys, chewing gum, screw tools or other small portable objects such as coins or folded bills or the like to which the user might want to access throughout the day. Thus, there exists a need for a grind shoe apparatus which incorporates storage capability for such objects so they can be easily accessed for usage during the time that the shoes are worn.

Further, athletes have come to appreciate that different style and shaped grind plates may be preferable for different applications and maneuvers. Thus, it is desirable to provide a grind shoe apparatus including a set of grind plates having different configurations for performing under different conditions. It has been found that for some maneuvers that the shoe apparatus incorporate a grind plate with a relatively high rise in an trough shaped plate thus dictating that the sole have a substantial height thereto so as to accommodate recess of the plate up into the sole itself. This then gives the shoe a rather distinctive appearance, particularly with the grind plate in position. It is desirable that such shoes be adaptable to be worn in certain environments having minimum attire requirements, requirements that would prohibit wearing of such a shoe which exhibits such a distinctive expression of athleticism. Consequently, there is a need for a grind shoe of this type which is convertible to an appearance other than that of a grind shoe itself. It is these needs to which the various embodiments of the present invention address.

SUMMARY OF THE INVENTION

The footwear apparatus of the present invention is characterized by a shoe sole having an upwardly raised recess therein to moveably receive a grind plate. The grind plate is formed on its bottom side with a low co-efficient of friction slide surface and on its top side with a rib work nesting against the top side of the recess and configured with a compartment for receipt of storable components. A fastener device is provided for removably fastening the plate to the shoe so that it can be removed for storage and retrieval of articles from such storage compartment.

In one embodiment, the footwear apparatus of the present invention includes a set of grind plates, one grind plate for use in sliding across a support surface such as a rail or the like and another grind plate which is in the form of a dummy plate to be removably fastened in the recess to camouflage the shoe itself as an ungrind shoe.

Other features and advantages of the invention will become apparent from the following detailed description, taken in conjunction with the accompanying drawings, which illustrate, by way of example, the features of the invention.

DETAILED DESCRIPTION OF THE PREFERRED EMBODIMENTS

Skateboarding offers users a wide range of acrobatic maneuvers that can be performed. One such maneuver involves the skater leaping, stepping or jumping onto a protruding feature of a supporting surface, such as a rail, to engage with the underside of the board with such support surface to slide along the protuberance in a sideways or forward stance. The maneuver, commonly known as "grinding," is practiced for fun and sport by numerous skaters and has gained much recent popularity. More recently in-line skating and snowboarding have evolved to utilize grinding maneuvers. Unfortunately, at the present time the maneuver can only be performed by athletes equipped with skateboards, in-line skates, or snowboards and therefore the availability of performing the maneuver is restricted to a limited number of persons on a limited number of occasions.

The apparatus of the present invention solves the aforementioned problem by incorporating a shoe sole, typically cushioned, with a cavity into which a grind plate is recessed to enable the user to perform grinding maneuvers. The apparatus provides the capability to perform grinding maneuvers without hampering the user's ability to continue with daily activities or to participate in such traditional exercises as walking, running, and working. In its most basic configuration the present invention comprises a grind plate that is attached within the bottom surface of a shoe sole to present a low friction, downward facing surface to slide along a support rail and the like. The grind plate is formed on its top side with a gridwork defining the body thereof and forming a compartment for storage storable components. As fully described below, the different designs and implementations of the present invention do not interfere with the normal walking or running gait cycle of the user. It must be understood that while each of the figures that accompany the disclosure depicts an article of footwear that is meant to be used on the left foot of a user, every embodiment disclosed herein is equally adaptable to use on the right foot of a user.

Figure 1:
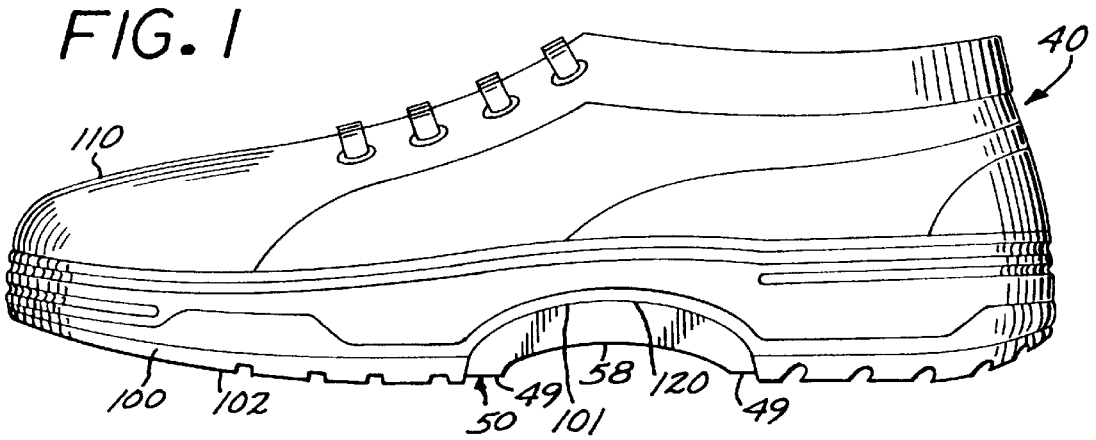
FIG. 1 is a side view of a grinding footwear apparatus of the type which may employ the present invention.

Referring to FIG. 1, the preferred embodiment of the present invention is comprised of an athletic shoe 40, that is, a shoe adapted in design and manufacture for activities involving running and jumping, and is commonly understood to include shoes such as running, cross training, aerobics, basketball, tennis, skateboarding and other similar shoes. The shoe 40 shown in the exemplary embodiment is a left shoe and includes, generally, an upper 110 mounted to a sole 100 formed with a cavity generally designated 120 extending across the arch region of the bottom surface 102 of such sole and formed at its opposite sides with respective upwardly projecting flares 101. The upper 110 may be formed from leather, canvas, plastic or any other material known in the art to provide the necessary strength and flexibility to enclose the user's foot. To fasten around the user's foot, the upper 110 may be provided with laces, Velcro™ hook and loop fasteners, or any other convenient fastening devices. The upper 110 may be mounted to the upper surface of the sole 100 by any workable method, including sewing the upper to the sole with thread, bonding with glue or epoxy, directly injecting, fusing, welding, molding the two pieces together, or any combination thereof.

Figure 3:
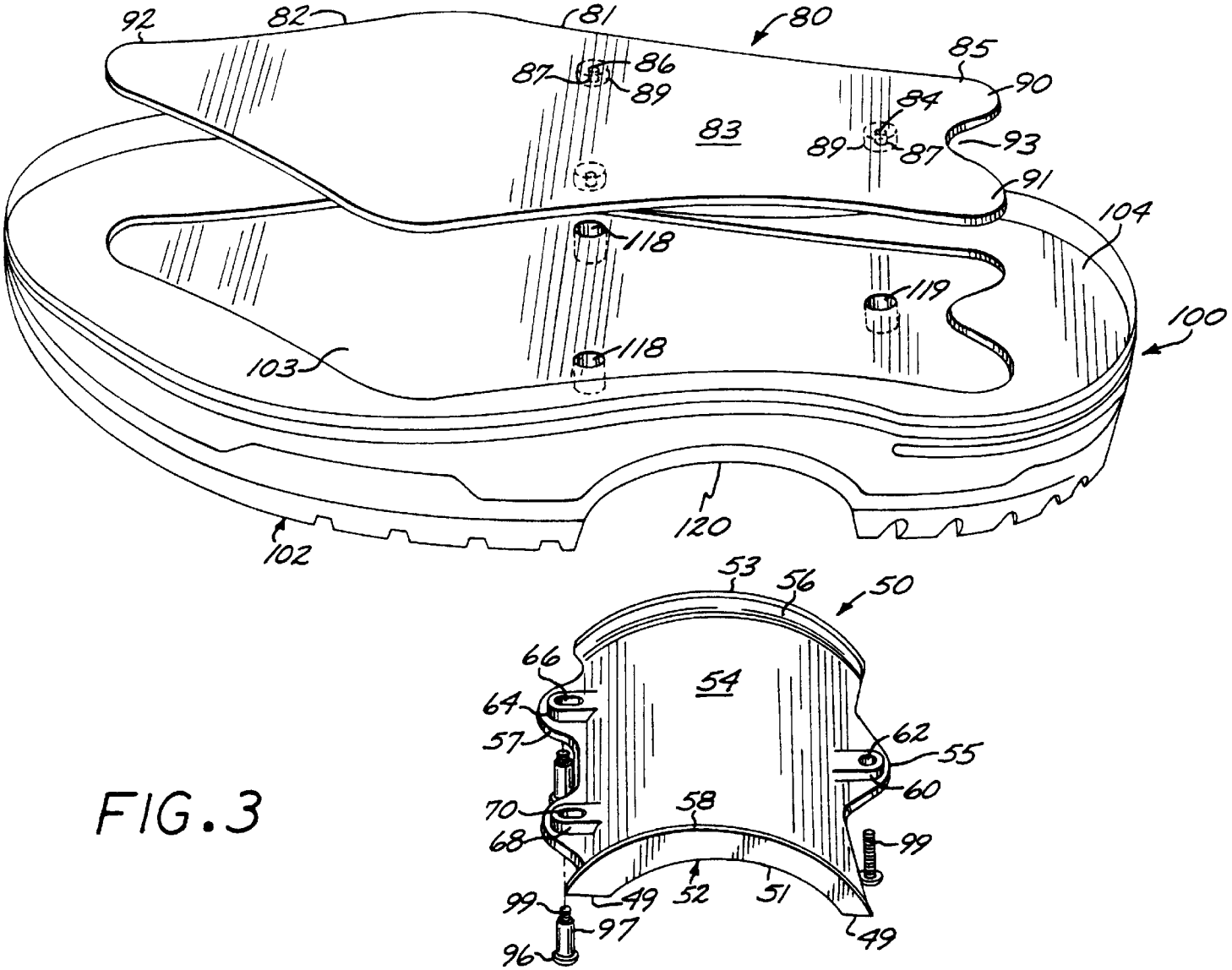
FIG. 3 is an enlarged scale exploded perspective view of the grind plate, sole and anchor plate assembly mounted to the footwear apparatus shown in FIG. 1.

As shown in FIG. 3, an arcuate grind plate 50 formed by a shaped sector of a cylindrical wall is configured with a convex upper surface 54 conforming substantially to the cavity 120 and a concave bottom surface in the form of a downward facing, substantially semi-cylindrical trough 52, and is fastened within such cavity 120. In the preferred embodiment, the sole 100 must be of sufficient thickness to accommodate a cavity 120 sized to retain the grind plate 50 at a depth of preferably 9 mm as measured between the high point of the trough 52 of the grind plate and the underlying horizontal supporting surface (herein after "rise"). It has been found that a rise ranging between 6 to 15 mm allows a relatively modest vertical profile for the shoe 40 (FIG. 1) while providing the necessary support to the arch of the foot as well as sufficient curvature to perform grinding maneuvers. A higher rise of approximately 13 mm is ideal, but the extra support provided by such a rise may be sacrificed in favor of a thinner sole 100 and a lower overall profile for the shoe. A sole 100 of about 27 mm to 35 mm in thickness, as measured along the longitudinal axis of the sole, has been found to accommodate a cavity of sufficient depth to allow for a grind plate 50 rise of 9 mm. The bottom surface 102 of the sole 100 that comes into contact with the supporting surface during the user's gait cycle may be formed with any tread pattern as dictated by the athletic functions the user of the shoe 40 (FIG. 1) intends to perform in addition to grinding, such as walking, running, jumping, etc.

Referring again to FIG. 3, the sole is formed in its top surface with a shallow contoured recess 103 and a peripheral wall defining a cup 104. The sole 100 is further formed with two anterior laterally spaced apart through bores 118 located on the opposite sides of the recess 103. The sole 100 is preferably compression molded from rubber heated to its glass transition temperature while applying pressure to conform the rubber into a mold bearing the desired sole configuration. Other materials such as leather, plastic or polyurethane may also be employed, but rubber is preferred for its abrasion resistance and relatively high coefficient of friction, both highly desirable characteristics for the soles of footwear. In addition, rubber is shock absorbent and greatly increases the comfort of the wearer by cushioning the foot from the impact of walking or running. Rubber can be easily cast in a variety of complex shapes and in any desired thickness, and can therefore be manufactured to accommodate practically any grind plate configuration. Furthermore, rubber can also be cast in varying degrees of hardness, and can be manufactured in any color and practically any surface pattern to appeal to the aesthetics and fashion sense of different market segments.

Most other materials typically used to manufacture shoe soles, while offering some or most of the desired characteristics, also have one or two drawbacks that render them less than ideally suited to the present application. Leather, for instance, offers excellent wear resistance and flexibility, but is difficult to form in the required thickness, has a relatively low coefficient of friction, and forming hollow cavities with complex configurations in a leather sole would place great demands on the craftsman and be labor intensive. Similarly, while plastic can be cast in almost any shape and exhibits relatively high wear resistance, compromises in plastic soles involves flexibility and resiliency, and so are typically not as comfortable as rubber soles.

Figure 2:
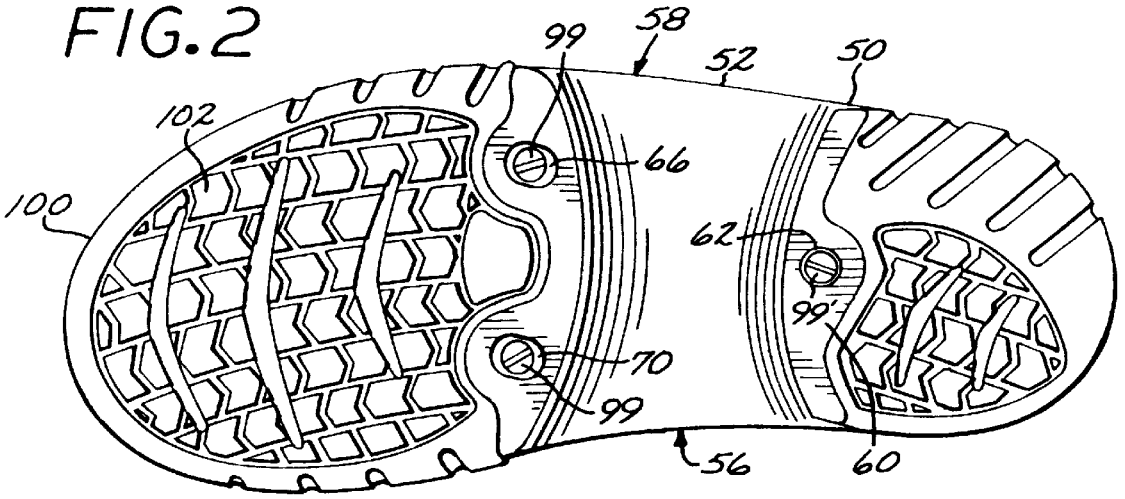
FIG. 2 is a bottom view of the footwear apparatus shown in FIG. 1.

With reference to FIGS. 2 and 3, the grind plate 50 is comprised of, in plan view, a four sided, generally trapezoidal monolithic body configured as a sector of a cylinder having a wall thickness of approximately 8 mm to provide sufficient structure to withstand shock and present sufficient body to endure considerable wear. The lateral side is configured to project in a generally straight line extending in the longitudinal fore-aft direction or in a direction angling forwardly and laterally at an angle up to about 5° to the fore-aft direction. The medial side angles forwardly and medially at an angle of about 15° from the fore-aft longitudinal direction to generally complement the cut of the medial instep of the sole of a conventional shoe. The bottom trough 52 is preferably formed with a smooth surface, generally semi-cylindrically spaced at the height of such trough with a radius of curvature of about 12 cm and flares upwardly at the opposite sides. The cylindrically shaped grind plate terminates at its anterior and posterior ends in downwardly facing edges 49 disposed in a horizontal plane spaced vertically above the horizontal plane including the horizontal bottom tread surface 102 defined by the bottom of the sole 100.

The grind plate 50 is constructed of a material selected to afford the desired low coefficient of friction sliding characteristic, as well as high abrasion resistance to withstand repeated sliding across abrasive supporting surfaces such as concrete. The grind plate must sustain sliding over an extended length of a vertical supporting surface and over the entire length of a downwardly sloping surface such as a typical staircase handrail, and the coefficient of friction should therefore be sufficiently low to allow the force created by gravity to cooperate with the forward momentum of the guide to overcome the frictional resistance of a rail, concrete curb, and the like. In addition, the material selected must offer substantial rigidity when injection molded in the dimensions specified in the disclosure to allow the user to maintain control while engaged in grinding maneuvers, because any undue flexing while sliding would adversely impact the user's ability to receive feedback from the reaction forces applied to the underside grind plate 50 and control its direction. A material known to exhibit these desirable characteristics is Supertuf 801 Nylon available from Dupont. Other materials that may be found to be acceptable include other forms of nylon, such as Nylon 6, plastics such as PTEX, hard rubbers, glass, ceramics, metals, polyethylene and composites. While a substantially rigid grind plate is preferred, those skilled in the art will realize that further embodiments of this apparatus may incorporate more flexible grind plates in order to appropriately tailor performance characteristics to meet the requirements of various grinding surfaces or grinding maneuvers.

Referring to FIG. 3, the configuration of the upper surface 54 of the grind plate 50 is an approximate mirror image of the bottom surface in a slightly larger radius of curvature and is upward facing, convex, and substantially semi-cylindrical. Practical considerations of considerable importance in forming the grind plate is the fact that the upper surface of the grind plate is received complementarily in a cavity formed in the shoe sole. It is advantageous if the configuration of this cavity does not require complex manufacturing steps. It is also desirable that the cavity in the sole does not adversely impact the characteristics of the sole, such as support, stability, safety, comfort, and strength. Thus, for example, an overly convex grind plate upper surface may necessitate an especially deep cavity in the sole that will dictate a very thick sole or else a very thin arch area that would offer only limited support and become prone to failure after a short service life. Similarly, a multi-faceted and angular grind plate upper surface may require additional manufacturing or finishing steps before the sole can be used in the final assembly. It has been found that the grind plate upper surface design of the present embodiment does not necessitate the use of an overly thick sole in the shoe, is relatively simple to manufacture, and cooperates with the arch of the sole to provide a supportive and comfortable platform for the user's foot.

As shown in FIG. 3, the top surface 54 of grind plate 50 is somewhat saddle shaped to curve upwardly in hyperbolic fashion at the opposite sides and is configured with respective medial and lateral raised arcuate, high performance rails 56 and 58 for extending along the flares 101 and cooperate to retain the foot centered over such plate and form respective outwardly facing curved slide runners 51 and 53 for gliding contact with the support surface when the shoe is laid over on its side. Such rails raise upwardly about 5 mm above the major top surface of such plate. The rearward edge of the grind plate is formed with a mounting flange 55 configured with a centrally disposed, rearwardly projecting posterior anchor tab 60 configured with a through anchor bore 62 aligned with the anchor bore 119 in the sole cup 104 and constructed on its bottom side with a downwardly opening countersunk recess. The grind plate is further formed at its anterior end with a forwardly projecting mounting flange 57 configured with a pair of laterally disposed anterior float tabs 64 and 68 formed with through, longitudinal fastener slots 66 and 70 configured to be disposed in alignment beneath the anterior bores 118 in such sole 100. The slide slots 66 and 70 are configured on their bottom sides with longitudinally extending countersunk recesses. The posterior and anterior flanges 55 and 57 are about 3 mm thick and the mounting tabs 60, 64, and 68 are approximately 6 mm thick.

Still referring to FIG. 3, one embodiment of the present invention also includes a foot frame defined by an anchor plate, generally designated 80 overlying the mid-sole to be received in the recess 103 and which may be in the form of a generally horizontal hard plastic foot frame 82 and having a swallow-tail shaped, rearwardly projecting heel portion 85. The foot frame 82 is configured in plan view with a wide, relatively thick forward control section 81 disposed forwardly under the arch of the foot and bulging medially outwardly and laterally outwardly forward of the two anterior bores 86 and 88. The edges thereof then curve forwardly and laterally inwardly to a form a thin rounded forward edge 92. The medial and lateral edges of the foot frame project rearwardly from the forward control section 81 to form an arch section 83 and a heel section 85 configured with outwardly flared rearwardly projecting tail sections 90 and 91 configured somewhat in the form of a swallow's tail and arranged to form therebetween a generally V-shaped rearwardly opening notch 93 disposed to the sides of the heel bone.

It will be appreciated by those skilled in the art that the bulk of the user's foot control is exhibited generally over the mid-foot section 83. To facilitate this control, the major rigidity in the foot frame is formed in the mid-foot section 83 which prevents excessive convex flexing of the foot and provides support to the user in the act of grinding. In addition, three bosses 89 triangulated about frame 83 cooperate to react torsional loading. The foot frame 82 projects forwardly approximately 3.5 cm from the control section 81 having a major width of 7.5 cm to form a rounded forward end 92 configured to control the flexibility of the forward portion of the shoe. Such plate tapers laterally rearwardly from such control section 81 to a width of about 5.5 cm for the heel section 85. The V-opening notch 93 is cut at a longitudinal depth of about 1.8 cm into the body of the foot frame itself and acts to prevent contact between the heel bone and the foot frame. The control section 81 is formed with a thickness of 2 mm and the thickness of the foot frame tapers gradually forwardly from the two anterior bores 86 and 88 to a minimum thickness of about 1 mm. The control section 81 is formed with the two laterally spaced bolt bores 86 and 88 aligned over the bores 66 and 70 formed in the float tabs 64 and 68 and the heel section 85 is formed with a central bolt bore 84 disposed over the anchor tab 60. The foot frame is formed with downwardly depending cylindrical bosses 89 (FIGS. 6 and 7) configured with upwardly opening sockets defining the bores 84, 86 and 88 which receive respective insert molded threaded tubular brass or stainless steel inserts 87. As will be apparent to those skilled in the art, in some embodiments, the anchor plate will take different shapes and may be formed with through unthreaded bores for slip fit of fastener screws receiving locking nuts or may be formed with integrally threaded bores to which the fastener screws might directly engage.

Referring once again to FIG. 3, the foot frame 82 is oriented such that the bolt bores 84, 86 and 88 are disposed directly over and coaxial with the corresponding front through bores 118 and aft through bore 119 formed in the sole 100, and the corresponding through bore 62 and slide slots 66 and 70 formed in the slide plate anterior and posterior mounting tabs 64, 68 and 60, respectively.

Referring to FIGS. 1, 3, 6 and 7, the anchor plate bores 84, 86 and 88 together with the slide plate through bore 62 and slide slots 66 and 70 cooperate with the through bores 118 and 119 formed in the sole 100 of the shoe 40 to receive a pair of anterior button head shoulder screws 99 and a posterior screw 99' to secure the slide plate 50, shoe 40, and foot frame 82 together in a snug, rattle free configuration by threading the fasteners into the threaded brass inserts 87 secured within the foot frame 82. The screws are preferably Nylock® self locking screws of 4 or 5 mm, approximately 12 mm head diameter, and varying length as dictated by the overall height of the slide plate tabs 60, 64 and 68, shoe sole 100, and bores 89. The shafts of the shoulder screws 99 are received through the forwardly projecting tab slots 66 and 70 and are sandwiched between the bottom end of the respective bosses 89 and annular shoulder of respective buttons the heads 96 of the fasteners.

In this embodiment, the shoulder screws 99 are sufficiently long to act as spacers to, when the screws are fully tightened, stand the shoulders of the respective button heads 96 about 1 mm off from the overlying bottom surface in the respective countersinks in the respective tabs 64 and 68 to provide some play for such tabs and allow relatively free floating thereof. Screws of various lengths and or materials such as elastomers may be used to accommodate different slide plate materials and thicknesses, giving the user the ability to adjust performance characteristics of the slide plate to match the requirements of different grinding surfaces.

The slide plate 50 is next selected and inserted within the cavity 120 of the shoe sole 100, where it is secured by threading the screws 99 through the slide slots 66 and 70 and the through bore 62, on through the through bores 118 and 119 formed in the shoe sole, and into the anchor plate threaded inserts 87. The screws are conveniently provided with engagement slots or sockets formed in the top surface of the heads 96 for engagement by a screwdriver or other tool for quick and easy turning of the screws. Alternatively, or in addition, high strength adhesives such as epoxy may be employed to fasten the slide plate to the surface of the sole cavity in a permanent configuration that sacrifices slide plate interchangeability for a stronger, more secure bond.

Slide plates 50 can be manufactured in a variety of styles to fit a variety of uses, and the rapid replacement feature detailed above enables quick swapping of slide plates to accommodate varying conditions and surfaces. The slide plates can thus be manufactured from different materials that will provide varying degrees of abrasion resistance and sliding ability to accommodate such different surfaces as, for example, concrete curbs and steel handrails. In this manner a user may choose, for example, a certain slide plate for grinding on a steel handrail and a different slide plate offering improved abrasion resistance when grinding on a concrete surface, and may also choose to install one type of slide plate on the right shoe and a different type of slide plate on the left shoe.

Slide plates 50 may also be formed with different downward facing configurations, and thus a slide plate adapted for steel rails may feature a through 52 with narrower sliding surface and with higher side rails 56 and 58, whereas a slide plate for concrete curbs may feature a wider, flatter sliding surface flanked by low side walls. In addition, slide plates may be manufactured in different colors that appeal to the fashion sense of the user, and individual slide plates may be formed with strata of different colors to indicate the level of wear upon the plate and thus aid the user in determining when the slide plate should be replaced.

Figure 8:
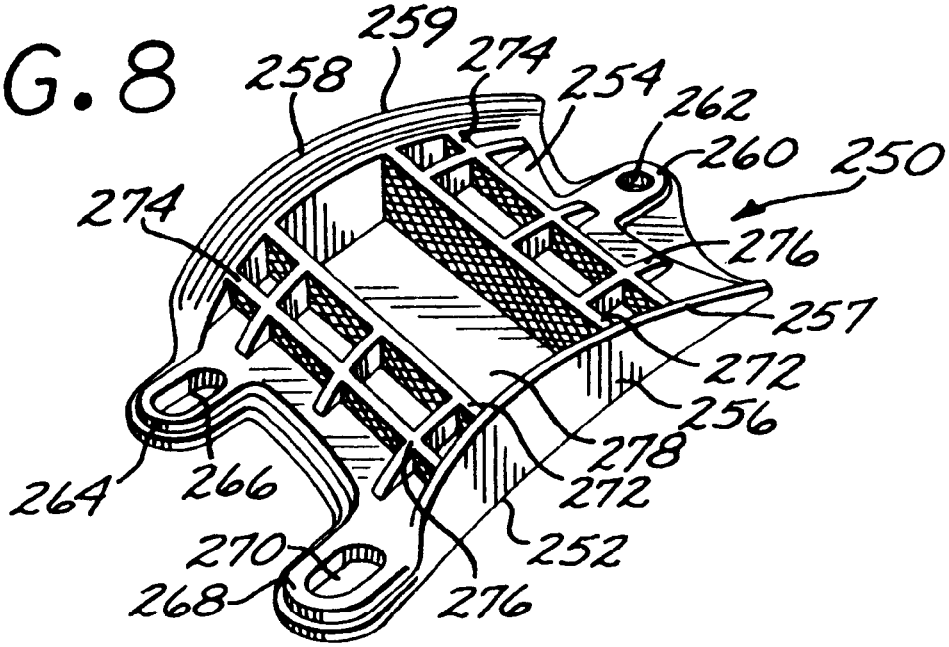
FIG. 8 is a top perspective view of a grind plate according to the present invention which may be fastened to the shoe shown in FIG. 1.

As shown in FIG. 8, the present invention includes a slide plate, generally referred to as 250, formed by a four sided, generally trapezoidal monolithic body 254 configured with a downward facing, concave, substantially semi-cylindrical trough 252 having a radius of curvature substantially less than that for the plate 50 and further including upturned, laterally disposed side walls 256 and 258 defining respective retainer rails terminating at their respective upper extremities in arcuate edges 257 and 259, respectively. The anterior extremity of such plate is formed with a contoured mounting flange configured with a pair of laterally spaced apart anterior flat tabs 264 and 268, including respective elongated slots 266 and 270. The posterior extremity of such plate is formed with a contoured mounting flange configured with a central, rearwardly projecting anchor tab 260 including through bore 262. The body of such plate is formed with a rectangular rib network defining respective laterally projecting inner ribs 272 and outer ribs 274 terminating at their respective upper edges flush with the upper edges of the arcuate rails 256 and 258. Longitudinal ribs 276 extend from each lateral inner rib 272 through each respective lateral outer rib 274. Formed between the inner ribs 272 and side rails 256 and 258 is a rectangular open top storage compartment 278 where users might store keys, gum, money or the like.

In operation, when a user desires to participate in a grinding exercise, he or she may select the plate 50 or 250 with the desired bottom contour. The grind plate is sufficiently recessed upwardly from the bottom surface of the sole 100 to reduce contact with the underlying sidewalk or the like.

Figure 4:
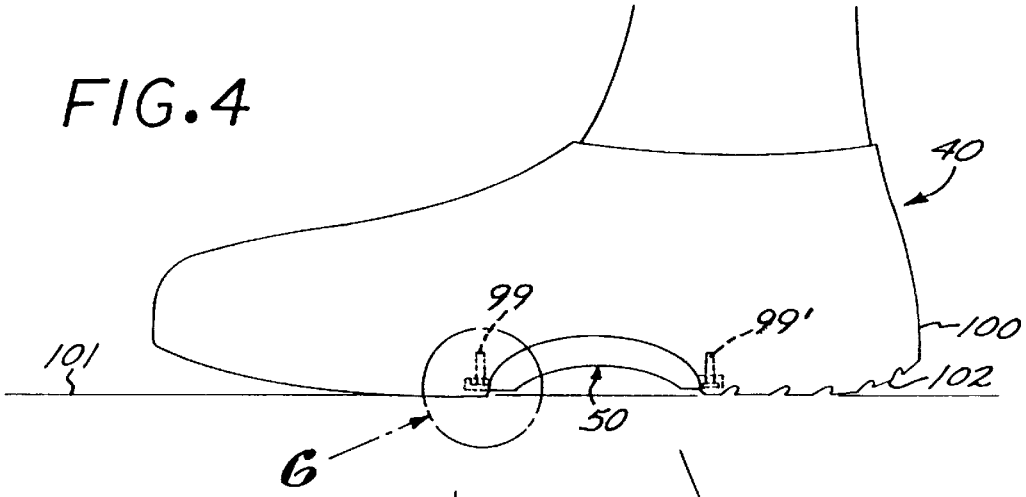
FIG. 4 is a side view of the footwear apparatus shown in FIG. 1 in operation during a walking gait with the entire sole contacting the ground.
Figure 5:
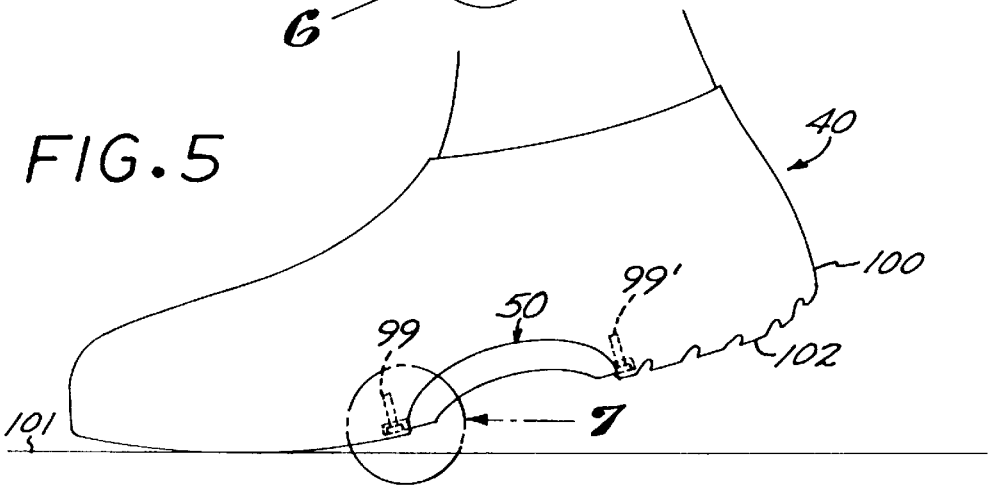
FIG. 5 is a side view of the footwear apparatus shown in FIG. 1 in operation during a walking gait with the forefoot portion of the sole contacting the ground.
Figure 6:
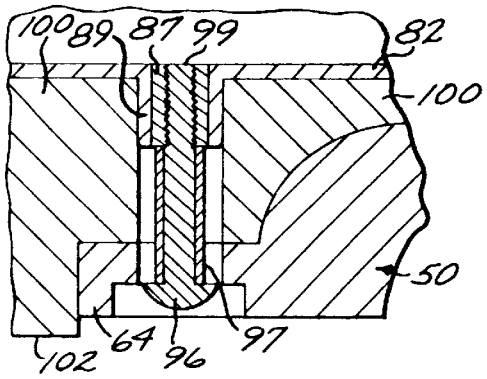
FIG. 6 is an enlarged section view of the front edge of the grind plate shown in FIG. 4.
Figure 7:
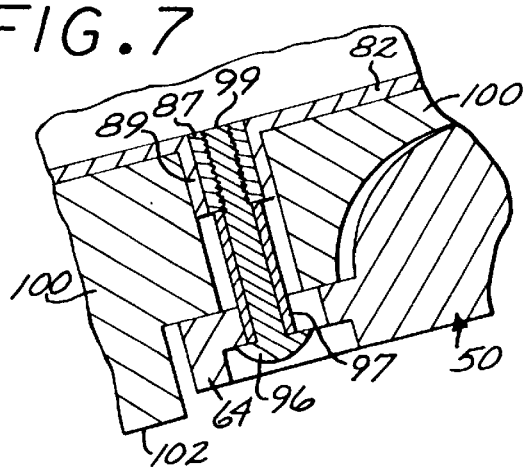
FIG. 7 is an enlarged section view of the front edge of the grind plate shown in FIG. 5.

Referring now to FIGS. 4 and 5, assuming the athlete has selected the higher rise plate 50, as he or she walks or runs along a sidewalk 101 or playground, the sole 100 of his or her shoe and the foot frame 82 will flex with each step taken to accommodate the bending of his or her feet, and the bottom surface 102 of each sole will therefore alternately expand and contract to accommodate this movement. Because the normal gait of an upright human involves first contacting the heel of the shoe and then rolling forwardly onto the ball of the foot and then lifting the heel up, most of the accompanying flex in the sole is localized in the forward and metatarsal area of the foot. As shown in FIGS. 6 and 7, the present invention is designed to accommodate this flexing by anchoring the grind plate 50 to the heel portion of the sole 100 through the rearwardly projecting mounting tab 60 and allowing the front of the grind plate to float relative to the front screws 99 by sliding of the float tabs rearwardly on such screws through the elongated slide slots 66 and 70 as the sole flexes when the heel is drawn upwardly and rearwardly to flex in somewhat of an arc as the heel is raised relative to the ball of the foot. The shoulders of the screws prevent the screw heads 96 from coming in contact with the bottom of the counter bored recesses in the anterior mounting tabs 64 and 68, and thereby serve to minimize wear and tear on the slide plate 50. The screw heads 96 are counter bored within the slide plate 50 and do not come into abrasive contact with the grinding surface, and therefore can be reused when the slide plate is replaced. The grind plate of the present invention thus allows the sole of the shoe to function along the supporting surface in the manner typical to most footwear and does not force the user to change her normal gait, unlike other specialized articles of footwear such as ski boots whose narrowly focused design comes at the expense of the basic functions of walking and running. The present invention therefore provides a single shoe apparatus that is equally adapted to the distinct functions of walking, running and sliding, and unites the two activities seamlessly with no loss of functionality or comfort.

It will be appreciated by those skilled in the art that the gradually increasing flexibility of the foot frame 82 forwardly of the control section 81 toward the toe 92 will distribute flexure of the sole 100 forwardly of the slide plate 50 for comfortable walking or running, and will serve to prevent the tendency of such sole to flex primarily just along a transverse line immediately forward of the front edge of such plate 50 to thereby avoid the tendency of such sole to over-flex, which over time, would form a weakening crease at that location and would allow debris to enter. Likewise, the foot frame will tend to distribute flexure of the sole rearwardly to thereby accommodate normal walking and running steps while avoiding the tendency to form a weakening crease at the rear of the slide plate 50.

It will be appreciated that in a highly athletic activity involving, for instance, an aggressive grinding maneuver wherein the athlete might jump with some force onto a hand rail, pipe or similar elongated surface, the landing force of the athlete may be several magnitudes greater than the weight of the athlete, i.e. exceeding eight times the weight of the athlete. As an athlete jumps onto, for instance, a pipe, the pipe will typically be received in the downwardly opening trough 52 of the grind plate 50 and more often than not the athlete will endeavor to land in a position causing the initial impact to be received on the medial rearward end of such plate in the area of the posterior mounting flange 55 with the relatively small radius of curvature of the trough 52, the support rail will be captured securely therein to quickly center the foot over such rail tending to restrict forward and rearward movement of the shoe relative thereto thus affording a feeling of secure engagement in the wearer. The slide plate 50 of the present invention has sufficient structural integrity to withstand such impacts and also accommodate the wear resulting from such plate sliding laterally over the surface of such underlying pipe. It is also of benefit that the force of the athlete's impact will exert forces downwardly through the saddle shaped plate 50 in a manner which will cause the upturned, upwardly curved lateral edges thereof to nest the shoe sole and foot even more firmly in a laterally centered position within the saddle shape of the plate.

As the athlete maneuvers in a gliding action along such pipe, he or she can maneuver the foot about to maintain control or execute further acrobatic maneuvers. In this regard, it will be appreciated by those skilled in the art that the foot frame 82 provides for torsional flexure while maintaining a secure coupling to the grind plate 50 to thereby impart control from the user's foot to the shoe sole and into the grind plate 50 for positive control thereof. The anchor plate 80 serves as a foot frame to distribute vertical forces laterally and longitudinally.

When the wearer elects to undertake a maneuver requiring a crouch position, he or she may bend the knees into a deep bend and lay one knee over medially which will involve inclining the grind plate 50 to a laterally inclined position, up to an incline approaching 75° or 80° from the horizontal. In this maneuver, the arcuate medial rail 56 will carry the entire weight placed on that foot of the user and the outwardly facing runner 53 will slide along the underlying pipe, again keeping the plate centered over the top of such pipe. It will thus be appreciated that the grind plate 50 provides for high performance grinding with a relatively secure capture of an underlying rail on the back of a park bench or the like thus minimizing forward and aft shifting of the weighted shoe relative to such underlying support. On other occasions, the athlete may prefer a grind plate contoured to provide for less resistance to fore and aft movement of the foot relative to an underlying rail to thereby provide for even more freedom of movement. In this instance, the athlete may want to select the grind plate 50 shown in FIG. 8.

To change from the plate 50 to the plate 250, it is only necessary to insert the broad blade screwdriver in the slots of the respective fastener heads 99 and rotate to remove the bolts 99 to allow removal of the plate 50. The plate 250 may then be extracted from the user's pocket, backpack or the like and the plate 250 positioned in place in the recess 120 in the shoe sole to then align the bore 262 with the bore 119 (FIGS. 3 and 8) and the slots 266 and 270 with the bores 118. A screw bolt 99' may then be inserted in the bore 262 in the plate, bore 119 in the sole and screwed into the boss 84. The screws 99 and 99' may then be tightened to secure the plate 250 in position.

Once the plates for both shoe have been exchanged, the user may then be on his or her way with the moved plates 50 stored in his or her backpack or the like. Then, when an obstacle to be ground is encountered, the wearer may take a running start and leap up onto the rail, curb or the like to address the shallow trough 252 against the rail surface to skid the plate sideways therealong. It will be appreciated that with the relatively shallow depth of the trough 252, the plate can be shifted relatively easily forwardly and rearwardly relative to the underlying support surfaces as skidding travel progresses therealong.

Figure 9:
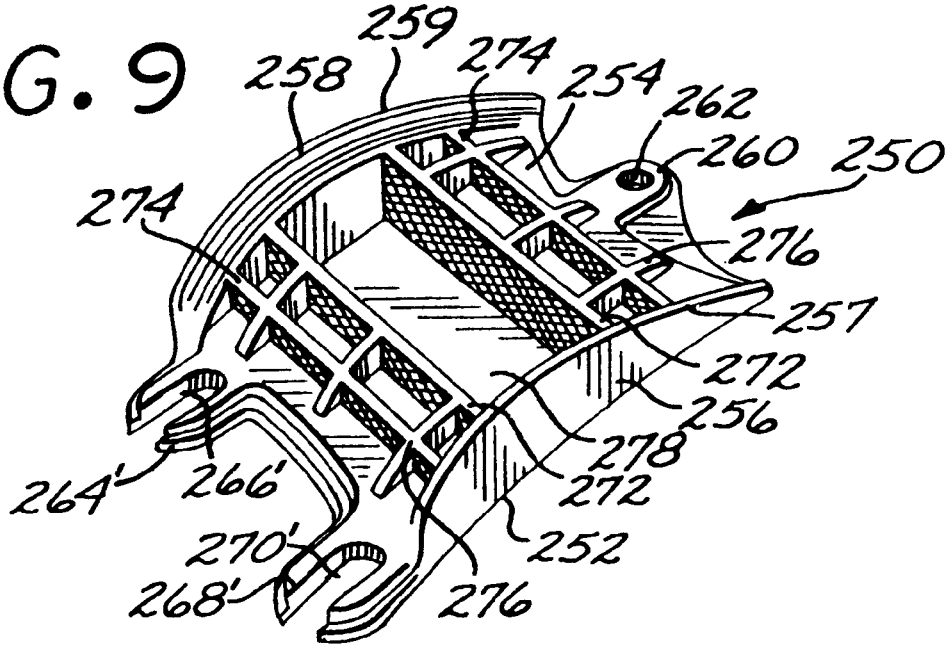
FIG. 9 is a top perspective view of a further embodiment of the grind plate of the present invention.

Referring to FIG. 9, the grind plate 250' shown therein is similar to the grind plate shown in FIG. 8 except that the tabs 264' and 268' are formed with forwardly opening elongated slots 266' and 270' for sliding receipt over the heads of the respective screws 99 for quick mounting and removal thereof without removal of the screws 99.

It will be appreciated by those skilled in the art that the grind plates 50, 250 and 500 may take different forms and configurations, it only being important that they nest securely in the bottom of the shoe and provide for convenient walking, running and grinding activities. The plate may extend laterally under the shoe as shown to form a transversely extending trough or lateral sliding of the shoe along the rail. In another embodiment, the plate may extend longitudinally under the shoe to provide for longitudinal sliding of the shoe along such rail. In some instances, the longitudinally extending plate will be formed with a forwardly concave trough extending in the longitudinal direction to facilitate and capture any underlying support rail. The variations as disclosed in our parent application, Ser. No. 08/890,595, filed Jul. 9, 1997, now U.S. Pat. No. 6,006,451 are contemplated as being within the scope of this invention.

Figure 10:
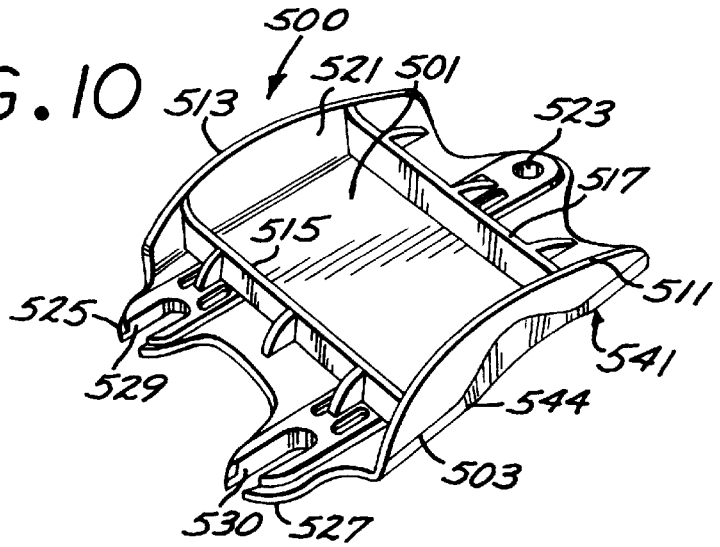
FIG. 10 is a top perspective view of a third embodiment of a grind plate according to the present invention.
Figure 11:
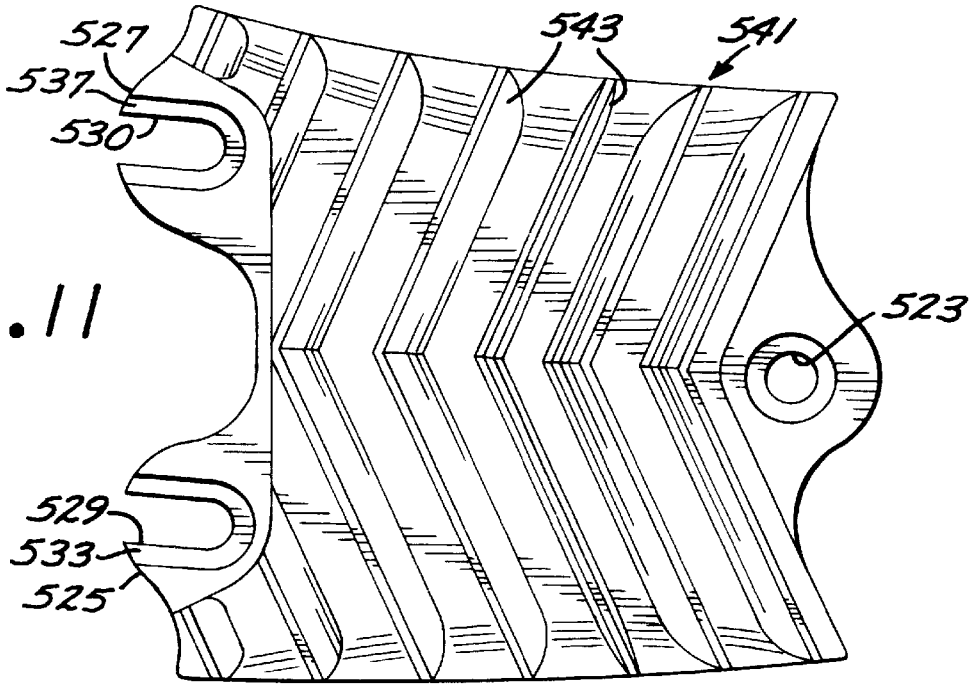
FIG. 11 is a bottom plan view thereof in enlarged scale.
Figure 12:
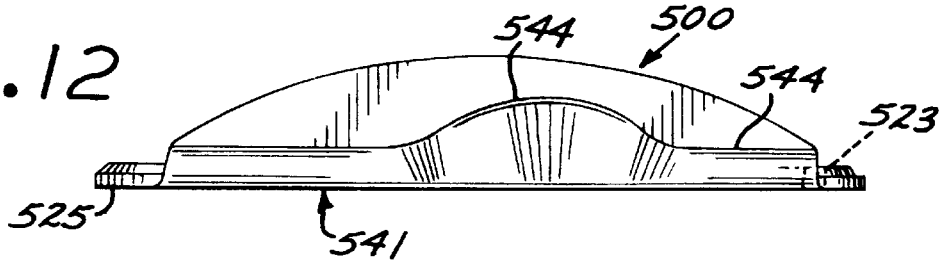
FIG. 12 is a medial side elevational view of the grind plate shown in FIG. 11.

For certain applications, it is desirable to convert the appearance of the shoe 40 such that neither the grind plate 50 or grind plate 250 is exposed to the casual observer. Also, it is desirable in some instances to camouflage the grinding characteristic of the shoe that has become so identified with the high rise recess 120 readily viewable from the lateral sides of the shoe. At this end, we have provided what we refer to as a "dummy" grind plate, generally designated 500 (FIG. 10). This dummy plate, like the grind plates 50 and 250, is generally elongated and is configured to project from the lateral to the medial side of the shoe sole. The dummy grind plate includes a generally planar bottom wall 501 having a generally flat bottom surface 503 and configured on its top side with a rib work having laterally disposed, longitudinally extending rails 511 and 513 projecting longitudinally along the opposite sides thereof and a pair of respective forward and rearwardly disposed end walls 515 and 517. The side rails 511 and 513 and end walls 515 and 517 cooperate to form a generally rectangular upwardly opening storage compartment.

The grind plate is further configured with a central rearwardly disposed anchor tab configured with an anchor bore 523 for alignment underneath the bore 119 in the shoe sole (FIG. 3). The plate 500 is formed at its forward extremity with a pair of laterally spaced apart quick release tabs 525 and 527, each of which are formed with respective forwardly opening slider slots 529 and 530. The quick release tabs 525 and 527 are formed to provide counter sunk margins 533 and 537, respectively, with the periphery of such slots 529 and 530 to form downwardly facing shoulders for cooperative receipt of the shoulders defined by the heads 96 of the respective fastener screws 99.

The plate 500 is covered on its underside by a tread layer, generally designed 541, which is configured on its bottom side with chevron shaped treads 543 and wraps upwardly on the opposite sides of the respective rails 511 and 513 to form longitudinally extending side tread lips 544.

In operation, it will be appreciated that the dummy plates 500 may be stored in the wearer's backpack or the like pending use. Once a destination is reached where the appearance of the shoe 40 is to be converted to a non-grinding shoe appearance, the grind plate 250 may be quickly and easily removed by again accessing the screws 99 and 99' and removing such screws to remove the plate 250. The corresponding plates 500 may then be attached to the shoe. If desired, the contents from the compartment 278 of the plate 250 may be transferred to the compartment 521 of the plate 500. Then, in the usual fashion, the plates 500 will be positioned upwardly in the respective recesses 120 and the bolts 99 and 99' reinserted. It will be appreciated that the bolt 99' will be inserted through the bore 523 (FIG. 10) and the bolts 99 inserted through the slots 529 and 530. It will be appreciated that, in use, the longitudinal slots 529 and 530 will provide for the desired lost motion characteristic as was provided by the slots 266 and 270 of the plate 250.

One further important feature of the plate 500 is that it may be used with other plates comparable to plate 50 or 250 which incorporate one or more open ended slots comparable to the slots 529 and 530. An example of this arrangement is shown in FIG. 9 where the grind plate 250' incorporates the forwardly opening quick release slots 266' and 270'. In those instances, it is not necessary to remove the screws 99 when the exchange has taken place. That is, in those instance it was only necessary to remove the anterior screw 99'and slide the respective slots 266' and 270' or 529 and 530 around the shanks of the respective shoulder screws 99 to engage the respective shoulders 533 and 537 over the shoulders of the heads of such screws. This then minimizes the inconvenience of exchanging plates on the bottom of the shoes and the risk of losing parts during such exchange.

Once the dummy plates 500 have been inserted and fastened to the respective shoes, the user is then in position to store the removed plates 250 and proceed on with the plates 500 in position. It is significant that these plates incorporate a bottom surface which is of relatively planar construction to thus dispel any suggestion of a grinding activity and to display the tread layer 541 which suggests high friction and further dispels any nothing of grinding activities.

From the foregoing, it is clear that applicants have provided a convenient and useful grinding shoe apparatus which allows the user to quickly and conveniently exchange plates on the bottom of the shoe and which provides for convenient storage of various items such as keys and the like. Furthermore, applicants' invention allows for the immediate conversion of what characteristically appears to be a grind shoe to a shoe which dispels any notion of grinding until such time as it is converted back.

While a particular embodiment of the invention has been illustrated and described, various modifications can be made without departing from the spirit and scope of the invention, and all such modifications and equivalents are intended to be covered.

What is claimed is:

1. Footwear apparatus for grinding along a support surface, comprising:

a shoe including a sole formed with a downwardly facing tread surface configured with a recess raising upwardly from the plane of said tread surface and opening downwardly;

a grind plate device including a grind plate received in said recess and formed on its bottom side with a downwardly facing slide surface having a predetermined low coefficient of friction for slidingly engaging said support surface, said grind plate device being formed on its top side with a storage compartment opening upwardly into said recess for storage of items to be removably place therein; and a fastener device for removably fastening said grind plate to said shoe within said recess.

2. Footwear apparatus according to claim 1, wherein:

said fastener device includes lost motion means to provide for relative movement between said sole and said plate.

3. Footwear apparatus according to claim 1, wherein:

said sole is formed with a fastener bore;

said grind plate is formed with a plate bore aligned with said fastener bore; and said fastener device includes a fastener removably received in said bores.

4. Footwear apparatus according to claim 1, wherein:

said plate device includes a dummy plate, said dummy plate being configured on its top side for receipt in said recess and including on its bottom side a substantially planar surface and further being engageable with said fastener device to be removably held in said recess.

5. Footwear apparatus according to claim 4, wherein:

said dummy plate includes a tread layer on the bottom of said planar surface.

6. Footwear apparatus according to claim 5, wherein:

said tread layer is configured to wrap upwardly on opposite sides of said dummy plate.

7. Footwear apparatus according to claim 4, wherein:

said grind plate and dummy plates are formed at their respective one extremity with respective open ended quick release slots; and said fastener device includes a fastener having a shank slidably receivable in the respective said quick release slots and having an enlarged retainer head for removably retaining the respective one extremities of said plates in position on said sole.

8. Footwear apparatus according to claim 7, wherein:

said grind and dummy plates are formed on their respective extremities opposite the respective said one extremities with respective fastener bores; and said fastener device includes a releasable fastener removably engageable with the respective said fastener bores.

9. Footwear apparatus according to claim 7, wherein:

said grind and dummy plates are formed at their respective said one extremities with respective second open ended slots spaced laterally from the respective first mentioned open ended slots and projecting parallel thereto and wherein:

said fastener device includes a second fastener having a shank received slidably in said second slot and an enlarged in cross section retainer head.

10. Footwear apparatus according to claim 1, that includes:

a flexible plate in said sole and projecting longitudinally thereof to distribute stresses therealong.

11. Footwear apparatus according to claim 1, that includes:

A elongated anchor plate in said sole and connected to said fastener device.

12. Footwear apparatus according to claim 1, wherein:

said grind plate is configured with said compartment rectangular in top plan view.

13. Footwear apparatus according to claim 1, wherein:

at least one side wall of said grind plate angles forwardly and outwardly to complement the shape of said sole.

14. Footwear apparatus according to claim 1, wherein:

said grind plate projects longitudinally of said shoe for grinding along an underlying surface in a longitudinal direction.

15. Footwear apparatus according to claim 1, wherein:

said sole is formed with said recess projecting transversely of the arch; and said plate is configured to project laterally from one side to the other of said arch.

16. Footwear apparatus according to claim 1, wherein:

said sole is formed with said recess projecting longitudinally therein; and said plate projects longitudinally in said recess.

17. Footwear apparatus according to claim 1, wherein:

said plate is configured on its top side with a reinforcing ribwork.

18. Footwear apparatus according to claim 1, wherein:

said plate is constructed of Nylon.

19. Footwear apparatus according to claim 1, wherein:

said sole includes a shock absorbing midsole.

20. Footwear apparatus according to claim 1, wherein:

said sole is an athletic shoe sole.

21. Footwear apparatus according to claim 1 wherein:

said plate includes upstanding front, rear and oppositely disposed side walls cooperating with the top wall of said recess to form said compartment.

22. Footwear apparatus according to claim 21 wherein:

said side walls are configured with laterally outwardly facing grind surfaces defining grind rails for sliding along said support surface when said footwear apparatus is tilted over to one side or the other.

23. Grinding footwear apparatus comprising:

a shoe including a sole formed with a downwardly facing tread surface having a recess raising upwardly therein;

a set of first and second plates for removable receipt in said recess, said plates formed on their respective top sides with respective top walls configured to be complementally received in said recess, said first plate being formed on its bottom side with trough raised upwardly a selected distance therein and said second plate being formed on its bottom side with a downwardly facing bottom trough raised upwardly therein a distance less then said selected distance and wherein;

said fastener is adapted to removably engage both said first and second plates.

24. Grinding shoe apparatus as set forth in claim 23 wherein:

said first plate is formed with said trough having one coefficient of friction and said second plate is formed with said second [tough] trough having a different coefficient of friction.

* * * * *